US010532604B2

(12) United States Patent
Depoi et al.

(10) Patent No.: US 10,532,604 B2
(45) Date of Patent: Jan. 14, 2020

(54) PIVOTING ENVELOPE INSERTION GUIDE

(71) Applicant: DMT Solutions Global Corporation, Danbury, CT (US)

(72) Inventors: Arthur H Depoi, Brookfield, CT (US); John R. Masotta, Newtown, CT (US); Anthony E. Yap, Danbury, CT (US)

(73) Assignee: DMT Solutions Global Corporation, Danbury, CT (US)

( * ) Notice: Subject to any disclaimer, the term of this patent is extended or adjusted under 35 U.S.C. 154(b) by 0 days.

(21) Appl. No.: 15/019,314

(22) Filed: Feb. 9, 2016

(65) Prior Publication Data

US 2016/0243882 A1 Aug. 25, 2016

Related U.S. Application Data

(60) Provisional application No. 62/118,531, filed on Feb. 20, 2015.

(51) Int. Cl.
*B43M 3/04* (2006.01)

(52) U.S. Cl.
CPC ..... *B43M 3/045* (2013.01)

(58) Field of Classification Search
CPC ..... B43M 3/045
USPC ..... 53/381.5, 381.6, 569, 255, 261, 572; 493/259, 258, 257, 309
See application file for complete search history.

(56) References Cited

U.S. PATENT DOCUMENTS 4,674,258 A 6/1987 Ehlscheid
4,955,185 A * 9/1990 Haas ..... B43M 3/045 53/284.3
5,024,042 A * 6/1991 Meyer ..... B65B 39/007 53/168
5,211,384 A * 5/1993 Orsinger ..... B43M 3/045 198/438
5,247,780 A * 9/1993 Kulpa ..... B43M 3/045 53/381.5
5,428,944 A * 7/1995 Belec ..... B43M 3/045 53/492
5,430,990 A * 7/1995 Long ..... B43M 3/045 53/252

(Continued)

FOREIGN PATENT DOCUMENTS

WO 9427832 A1 12/1994
WO 0017052 A1 3/2000
WO 2010027522 A1 3/2010

*Primary Examiner* — Chelsea E Stinson
*Assistant Examiner* — Thomas M Wittenschlaeger
(74) *Attorney, Agent, or Firm* — Brown Rudnick LLP

(57) ABSTRACT

A method is provided for using a rotatable insertion horn to open an envelope prior to insertion of documents. A pair of insertion horns is positioned at the sides of an envelope inserting station. An envelope is fed into the envelope inserting station with its flap open. The collation of documents is pushed into the open end of the envelope. The insertion horns are positioned in an initial position that is fully outside the envelope, prior to arrival of the collation. The insertion horns are controlled to simultaneously rotate into the envelope as the collation passes between the insertion horns. Preferably, rotation of the insertion horns into the envelope does not begin until a lead edge of the collation is in a region between the insertion horns. This facilitates insertion of the collation without catching on an upstream edge of the insertion horns.

11 Claims, 5 Drawing Sheets

(56) References Cited

U.S. PATENT DOCUMENTS

| | | | | | |
|---|---|---|---|---|---|
| 5,457,941 | A * | 10/1995 | Long | B43M 3/045 | 53/252 |
| 5,517,797 | A * | 5/1996 | Ballard | B43M 3/045 | 53/381.5 |
| 5,675,959 | A * | 10/1997 | Hamma | B43M 3/045 | 53/381.1 |
| 5,802,808 | A * | 9/1998 | Lyga | B43M 3/045 | 53/381.5 |
| 5,992,132 | A * | 11/1999 | Auerbach | B43M 3/045 | 493/259 |
| 6,164,046 | A * | 12/2000 | Werner | B43M 3/045 | 53/284.3 |
| 6,718,740 | B2 * | 4/2004 | Rivenbark | B43M 3/04 | 53/381.5 |
| 6,978,583 | B2 * | 12/2005 | Rozenfeld | B43M 3/045 | 53/381.5 |
| 7,181,895 | B1 * | 2/2007 | Rozenfeld | B43M 3/045 | 53/284.3 |
| 7,600,755 | B1 | 10/2009 | Rozenfeld | | |
| 7,770,368 | B2 * | 8/2010 | Sugimoto | B43M 3/045 | 53/284.3 |
| 7,905,076 | B2 * | 3/2011 | Rozenfeld | B43M 3/045 | 270/58.06 |
| 7,971,865 | B2 * | 7/2011 | Kern | B43M 3/045 | 270/58.06 |
| 8,281,919 | B2 * | 10/2012 | Rozenfeld | B43M 3/045 | 198/571 |
| 8,439,182 | B2 | 5/2013 | Rozenfeld | | |
| 2006/0042196 | A1 * | 3/2006 | Stemmle | B43M 3/045 | 53/492 |

* cited by examiner

PIVOTING ENVELOPE INSERTION GUIDE

FIELD OF THE INVENTION

The present invention relates generally to multi-station document inserting systems, which assemble batches of documents for insertion into envelopes. More particularly, the present invention is directed toward an envelope feeder-insert station having a rotatable insertion horn for opening an envelope prior to insertion of documents into the envelope.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mall-item are substantially identical for each addressee. Examples of such inserter systems are the MPS and Epic™ inserter systems available from Pitney Bowes, Inc., Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation. For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to the burster-folder station for separating and folding. A control scanner located in the burster-folder station senses the control marks on the control documents. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope. The transport deck preferably includes a ramp feed so that the control documents always remain on top of the stack of advancing documents. A typical modern inserter system also includes a control system to synchronize the operation of the overall inserter system to ensure that the collations are properly assembled.

In regards to the envelope feeder-insert station, they are critical to the operation of document inserting systems. Typically, such an envelope insert device inserts collated enclosures into a waiting envelope. Envelope inserting machines are used in a wide range of enclosure thickness' and also with enclosures which are not significantly different in length than the length of the envelopes into which they are inserted. The difference between the length of the enclosures and the envelope should be minimized so that the addressing information printed on the enclosure which is intended to appear in the envelope window does not shift in position and become hidden.

In Pitney Bowes high speed insertion machines, the mechanical paper guides herein called 'horns' are used form the entrance of the envelope so that an incoming collation is cleanly guides into the envelope. The horn extends approximately 50 mm into the envelope to further shield the collation from the inside edges of the envelope. The horns are mounts on servo motors, which retract the horns away from the envelope to allow suction cups to initially open the envelope. Afterwards, the servo motors will rotate the horns into the partially opened envelope to complete the opening of the envelope. Typically these horns are angled inwards to create a tunneling effect so that the collation does not catch on entry to the horn. However, this angle reduces the maximum collation width that can be run. Once the horns are extended into the envelope, a collation of mail contents is inserted into the envelope.

Prior art inserting systems are described in the following patents, which are hereby incorporated by reference:

U.S. Pat. No. 5,992,132—Rotary Envelope Insertion Horn

U.S. Pat. No. 6,978,583—High Speed Vacuum System for Inserters;

U.S. Pat. No. 7,181,895—Jam Tolerant Mail Inserter;

U.S. Pat. No. 7,600,755—System and Method for Preventing Envelope Distortion in a MailPiece Fabrication System;

U.S. Pat. No. 8,281,919—System for Controlling Friction Forces Developed on an Envelope in a Mailpiece Insertion Module;

U.S. Pat. No. 8,439,182—Mail Piece Inserter Including System for Controlling Friction forces Developed on an Envelope.

Therefore it is an object of the present invention to overcome the difficulties associated with insertion horns that facilitate the insertion of documents into an envelope.

SUMMARY OF THE INVENTION

Accordingly, the Instant invention provides a method for using a rotatable insertion horn tor opening an envelope prior during insertion of documents into the envelope. In this method, a pair of insertion horns are positioned at the sides of an envelope inserting station. The insertion horns rotate into the envelope to open the envelope's sides to form a clear channel for the collation to enter. An envelope is fed into the envelope inserting station with its flap open. The collation of documents is pushed into the open end of the envelope. The insertion horns are positioned in an initial position that is fully outside the envelope, prior to arrival of the collation. The insertion horns are controlled to simultaneously rotate into the envelope as the collation passes between the insertion horns. In the preferred embodiment, rotation of the insertion horns into the envelope does not begin until a lead edge of the collation is in a region between the insertion horns. This facilitates insertion of the collation without catching on an upstream edge of the insertion horns.

In a further preferred embodiment, the insertion horns are controlled to rotate fully into the envelope such that side walls of the insertion horns are parallel with the sides of the envelope. This allows maximum space for the width of the collation. After insertion, the insertion horns can be relaxed from their full insertion position by rotating the insertion horns away from the sides of the envelope. This relaxation removes fractional contact between the sides of the envelope and the insertion horns, and allows subsequent feeding of the stuffed envelope from the envelope inserting station. After the stuffed envelope leaves the station, the insertion horns are moved back to the initial position and another empty envelope is fed into the insert station.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
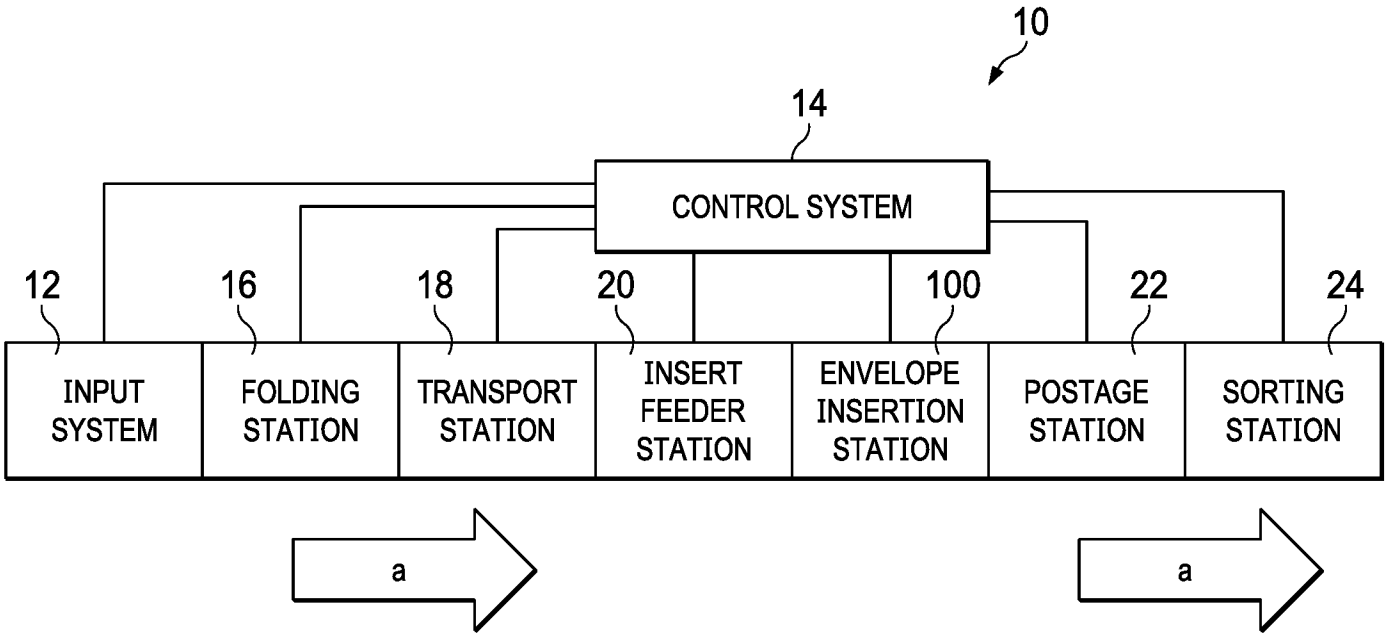
FIG. 1 is a block diagram schematic of a document inserting system in which the present invention input system is incorporated.

Referring to FIG. 1, a schematic of a document inserting system according to one embodiment of the present application is shown. The document inserting system 10 includes an insertion station 100. The document insertion system 10 is illustrative and many other configurations may be utilized.

System 10 includes an Input system 12 that feeds paper sheets from a paper web to an accumulating station that accumulates the sheets of paper in collation packets. Preferably, only a single sheet of a collation is coded (the control document), which coded information enables the control system 14 of inserter system 10 to control the processing of documents in the various stations of the mass mailing inserter system.

Input system 12 feeds sheets in a paper path, as indicated by arrow "a," along what is known as the main deck of inserter system 10. After sheets are accumulated into collations by input system 12, the collations are folded in folding station 16 and the folded collations are then conveyed to a transport station 18, preferably operative to perform buffering operations for maintaining a proper timing scheme for the processing of documents in insertion system 10.

Each sheet collation is fed from transport station 18 to Insert feeder station 20. It is to be appreciated that an inserter system 10 may include a plurality of feeder stations, but for clarity, only a single insert feeder 20 is shown. Insert feeder station 20 is operational to convey an insert (e.g., an advertisement) from a supply tray to the main deck of inserter system 10 so as to be combined with the sheet collation conveying along the main deck. The sheet collation, along with the nested insert(s), are next conveyed into envelope insertion station 100 that is operative to first open the envelope and then insert the collation into the opening of the envelope. The envelope is then conveyed to postage station 22. Finally, the envelope is conveyed to sorting station 24 that sorts the envelopes in accordance with postal discount requirements.

Figure 2:
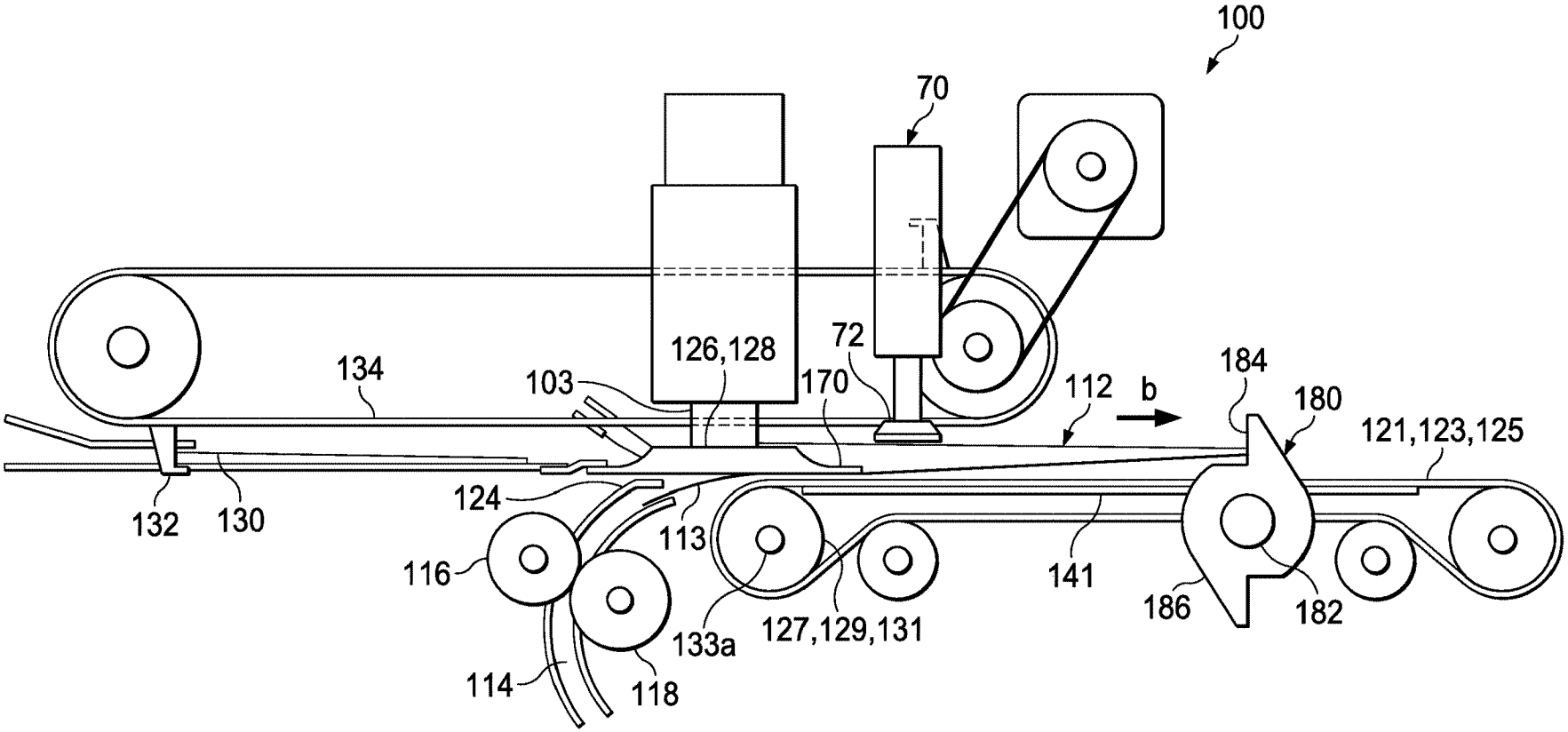
FIG. 2 is a side, elevational view of an envelope inserting apparatus using the present invention insertion horns.

Referring now to FIG. 2. an insertion device 100 according to an illustrative embodiment of the present application is shown. For clarity, FIG. 2 depicts an insertion station 100 without illustrating any enclosure collations or envelopes, in operation, an envelope enters the insertion station 100 along a guide path 114 and is transported into the insertion station 100 by a set of transport rollers 116 and 118 and continuously running transport belts 121, 123 and 125. Each transport belt 121, 123 and 125 respectively wraps around rollers 127, 129 and 131, each roller being connected to a common shaft 133*a*. Each transport belt 121, 123 and 125 is juxtaposed between deck strips that form transport deck 141 of insertion station 100.

The motion of each transport belt 121, 123 and 125 is continuous for maintaining registration of an envelope 112 against a backstop 180. Continuous vacuum from each of the deck strips via their respective vacuum plenums prevents any jiggling. Of the envelope even though the transport belts 121, 123 and 125 are continuously running beneath.

Rotating backstop members 180 are preferably located outside the vacuum deck strips in an elongate slot. Each backstop member 180 is concentrically mounted about a common shaft 182 for effecting rotation thereof. Each stopping portion 184 is configured to stop an envelope when it is above the deck 141 of insertion station 100. A servo motor (not shown) causes rotation of the backstops members 180 about axle 182.

Insertion station 100 Includes envelope flap retainers 124 and rotating insertion horns 126 and 128 each having an underside that assists in helping an envelope conform to each transport belt 121, 123 and 125 while not presenting any catch points for the leading edge of the enclosure collation 130 to be inserted in a waiting open envelope 112. The horns 126 and 128 are supported from above the envelope path and are eccentrically mounted on pivot shafts 103. They are positioned perpendicular to the path of the envelope travel as the envelope is conveyed to backstop members 180. Once the vacuum assembly 70 has begun to open the envelope, the insertion horns 126 and 128 can be pivoted into the envelope in a manner that will be further discussed in connection with FIGS. 3-5. Insertion horns 126 and 128 will move into the envelope so that the outer edges of the envelope have been shaped and supported. Rotating insertion horns 126 and 128 perform the additional function of centering envelope 112 in the path of the oncoming enclosure collation 130. The pivot shafts of each insertion horn 126 and 128 are driven by a servo motors 104 end 105 (see FIGS. 3-5).

Insertion station 100 further includes an envelope opening vacuum assembly 70 for separating the back panel of an envelope from its front panel. Vacuum assembly 70 is perpendicular to the transport deck 141 of insertion station 100. Vacuum assembly 70 includes a reciprocating vacuum cup 72 that translates vertically downward toward the surface of the transport deck 141 and then upward away from the transport deck 141 to a height sufficient to allow a stuffed envelope to pass under. The vacuum cup 72 adheres to the back panel of an envelope, through a vacuum force present in vacuum cup 72 so as to separate the envelopes back panel away from its front panel during upward travel of the vacuum cup 72.

The enclosure collations 130 are fed Into the Insertion station 100 by means of a pair of overhead pusher fingers 132 extending from a pair of overhead belts 134 relative to the deck of inserter system 10. As with the envelope 112, the top side of the envelope flap retainers 124 and the associated interior of me insertion horns 126, 128 must not present any catch points for the leading edge of the enclosure collation 130.

Referring to FIG. 2, a method of operation according to an illustrative embodiment, of the present application is described. An envelope 112 is conveyed to the transport deck 141 of insertion station 100 via guide path 114 (which is in connection with an envelope supply (not shown)). Once a portion of the envelope 112 contacts the continuous running transport belts 121, 123 and 125, these transport belts convey envelope 112 downstream as indicated by arrow B, in insertion station 100. Concurrently, each deck strip of transport deck 141 provides a continuous vacuum force upon envelope 112 (via vacuum plenums) so as to force envelope 112 against the continuous running transport bets 121, 123 and 125. Next, an elongate stopping portion 184 of backstop member 180 is caused to extend above the transport deck 141 at a height sufficient to stop travel of the envelope 112 in insertion station 100. The leading edge of the envelope 112 then abuts against the stopping portion 184 of backstop member 180 so as to prevent further travel of the envelope 112.

While the envelope 112 is abutting against the stopping portion 184 of backstop member 180, the transport belts 121, 123 and 125 are continuously running beneath the envelope 112. To prevent jiggling of the envelope 112 (as could be caused by the friction of continuous running transport belts 121, 123 and 125) the continuous vacuum force applied to the envelope 112 by the deck stops functions to stabilize the envelope 112 on the transport deck 141 while it is abutting against backstop member 180.

Figure 3:
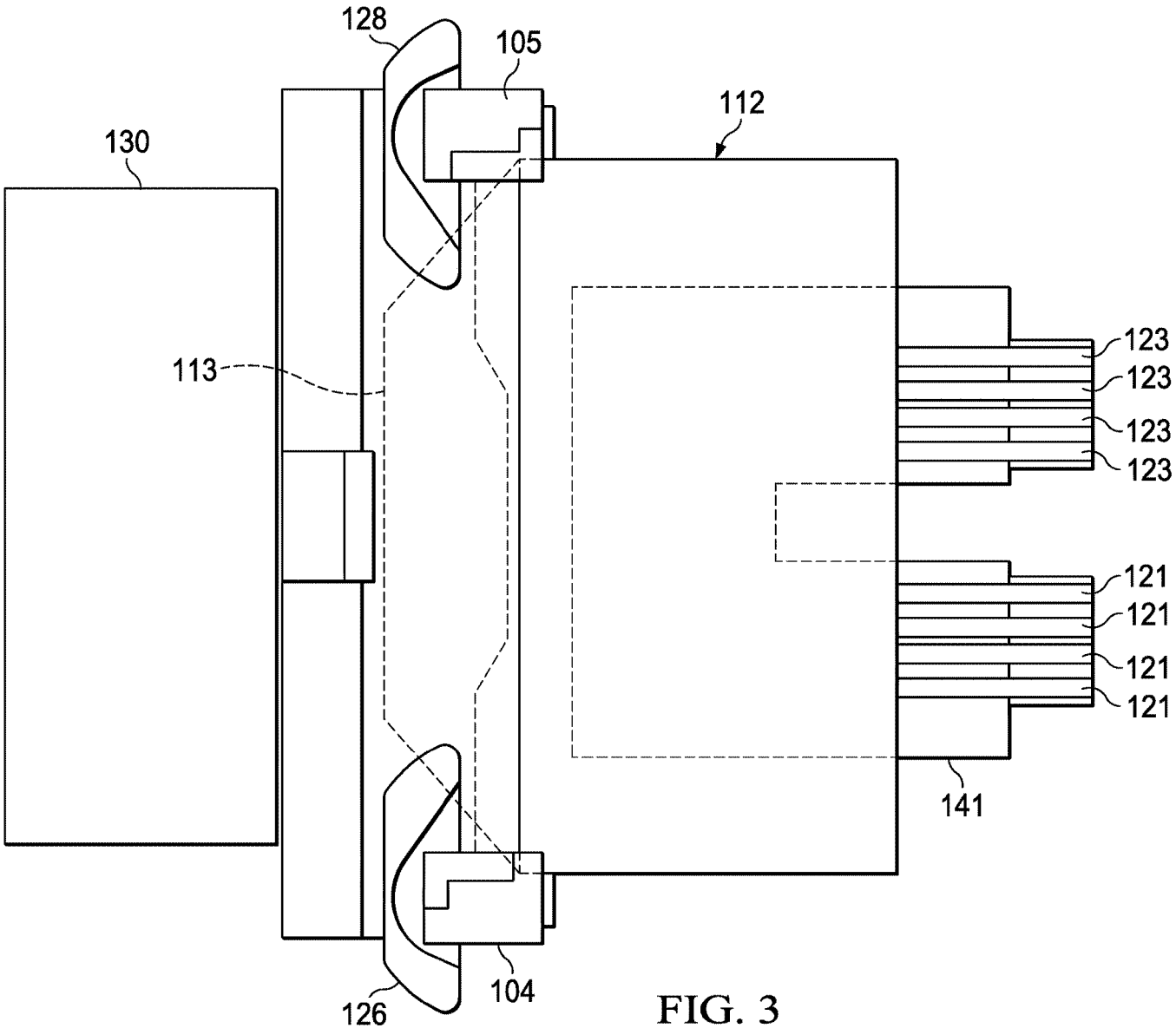
FIG. 3 is a fop view showing the initial positioning of the horns prior to beginning an insertion operation.
Figure 4:
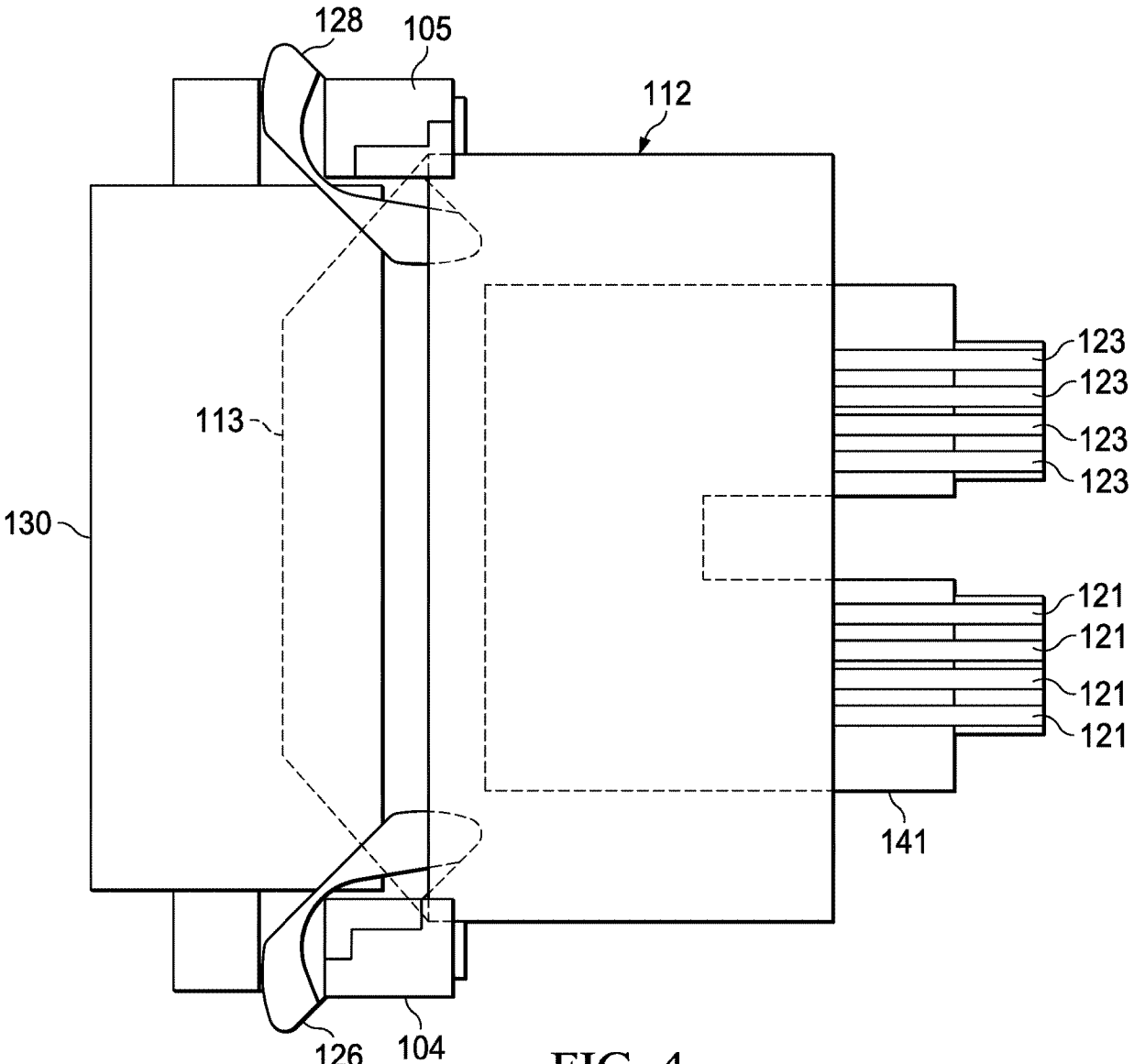
FIG. 4 is a top view showing the intermediate positioning of the horns as a collation is approaching insertion.
Figure 5:
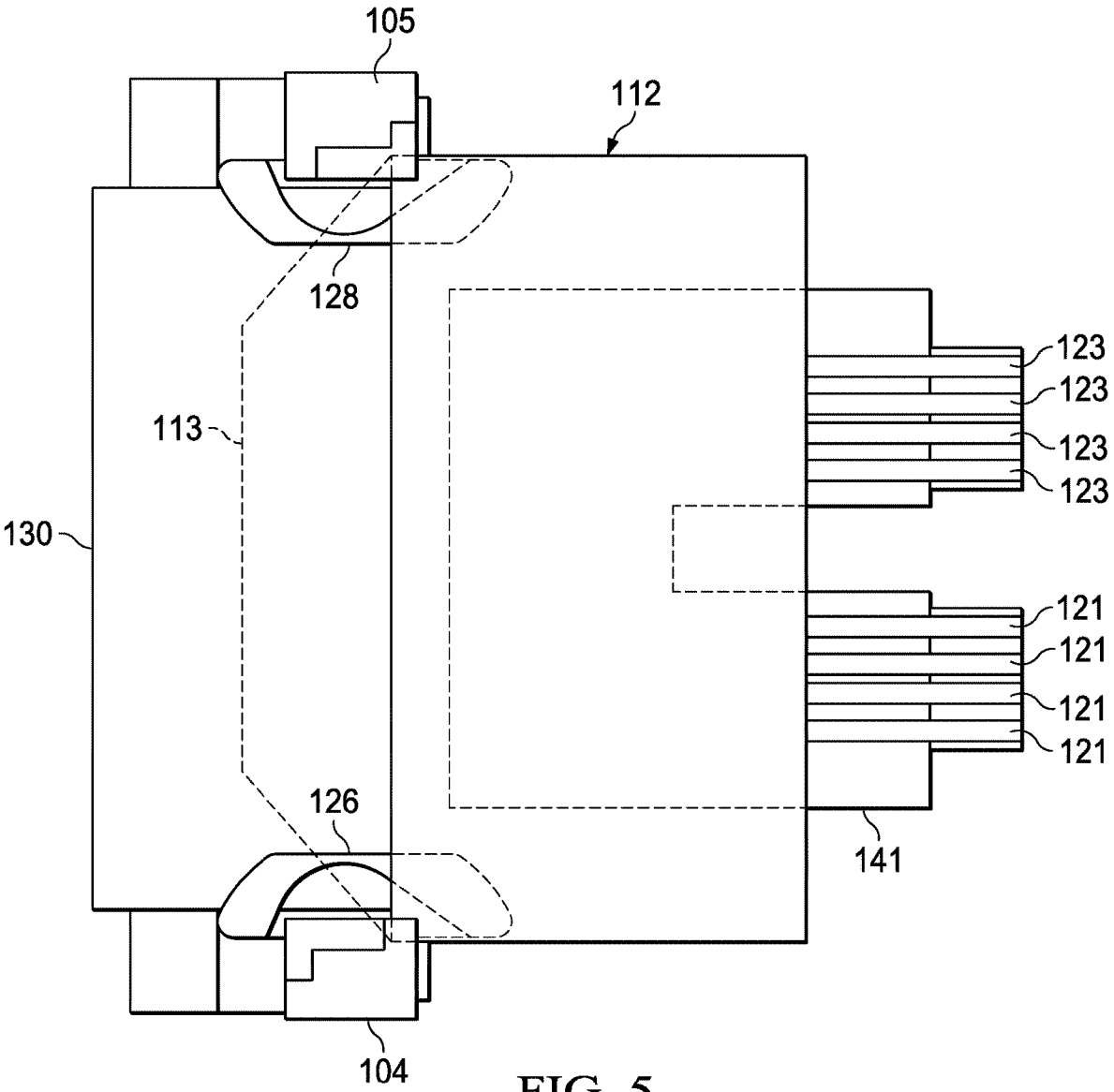
FIG. 5 is a top view showing a final position of the horns as a collation is being inserted into the envelope.

When envelope 112 is disposed in insertion station 100, the vacuum cup 72 of vacuum assembly 70 is caused to reciprocate downward toward the back panel of envelope 112. The vacuum cup 72 adheres to the back panel and then reciprocates upwards so as to separate the back panel from the envelope front panel to create an open channel in the envelope 112. Enclosure collation 130 is then conveyed toward the envelope 112 by pusher fingers 132. At first, as shown in FIG. 3, the insertion horns 126, 128 are positioned in a first position wherein their respective stripper blade portions 170 are positioned outside of the open end of the closed envelope 112. Then as the collation 130 is advanced toward the open channel of envelope 112, and the lead edge of the collation 130 is between the horns 126 and 128, each Insertion horn 126 and 128 is gradually pivoted towards its second position, When the lead edge is between the horns they will be at approximately 45 degrees (see FIG. 4). Finally, as seen in FIG. 5, the insertion horns 126 and 128 are pivoted fully into the envelope as the collation 130 begins to enter the envelope. At this point, the horns 128 and 128 are preferably at ninety degrees. In this manner, the pivoting Insertion horns 126 and 128 provide a guide path into the open channel of the envelope 112 into which an enclosure collation 130 travels through and into the envelope 112. This method avoids catching on the upstream edge of the horns 126, and the edges of the envelope 112.

The method of operation will now be discussed in conjunction with reference to FIGS. 3-5. Referring to FIG. 3, with an envelope 112 disposed in insertion station 100, an enclosure collation 130 is conveyed by pusher fingers 132 (FIG. 2) toward envelope 112. At first, the insertion horns 126, 128 are positioned in a first position wherein their respective stripper blade portions 170 are positioned outside of the open end of the closed envelope 112. Referring now to FIG. 4 as the collation 130 is advanced to a position between the horns 126 and 128 into the open end of envelope 112, each insertion horn 126 and 128 is pivoted in synchronized motion with the collation 130. Thus when the lead edge of the collation 130 is between the horns 126 and 128, the horns are positioned at approximately 45 degrees. Finally, as shown in FIG. 8, the horns 126 and 128 are moved to a full insertion position, approximately 90°, preferably at about the time the collation is just starting to enter the opening to the envelope 112.

After the enclosure collation 130 is inserted into the envelope 112, the insertion horns 126 and 128 are caused to relax by to an angled position, about 5 degrees, so that they are no longer pressing on the outer edges of the envelope 112. The will reduce friction so that the envelope 112 can be more easily withdrawn from the insert station 100. The above process for inserting another collation into another envelope is then repeated.

Thus, an advantage of the present invention pivoting insertion horns 126 and 128 are that they can be used to open an envelope to the fullest extent while guarding against a collation hitting an edge of the envelope 112 or an edge of the horns 126 and 128 themselves.

Although the invention has been described with respect to preferred embodiments thereof it will be understood by those skilled in the art that the foregoing and various other changes, omissions and deviations in the form and detail thereof may be made without departing from the spirit and scope of this invention.

What is claimed is:

1. A method for automated insertion of a collation into an envelope wherein a pair of insertion horns is positioned at the sides of an envelope inserting station and such insertion horns rotate into the envelope to open the envelope's sides to form a clear channel for the collation to enter, the method comprising, feeding the envelope into the envelope inserting station with its flap open;

pushing the collation into the open end of the envelope;

positioning the insertion horns in an initial position that is fully outside the envelope, prior to arrival of the collation; and controlling the insertion horns to simultaneously rotate from the initial position into the envelope as the collation is pushed between the insertion horns such that the insertion horns are fully rotated about 90 degrees relative to the initial position into the envelope as the collation begins to enter the envelope, and thereby facilitating insertion of the collation without catching on an upstream edge of the insertion horns.

2. The method of claim 1 wherein the insertion horns are controlled to rotate fully into the envelope such that side walls of the insertion horns are parallel with the sides of the envelope.

3. The method of claim 2 including a further step of relaxing the insertion horns from their full insertion position by rotating the insertion horns away from the sides of the envelope to remove frictional contact between the sides of the envelope and the insertion horns; and subsequently feeding a stuffed envelope from the envelope inserting station.

4. The method of claim 3 including a further step of returning the insertion horns back to the initial position prior to feeding of a subsequent empty envelope onto the envelope inserting station.

5. The method of claim 1 wherein rotation of the insertion horns into the envelope does not begin until a lead edge of the collation is in a region between the insertion horns.

6. A collation insertion mechanism in an envelope inserting machine, the mechanism comprising:

a collation pusher for pushing a collation into an envelope at an inserting station;

an envelope feeder that feeds envelopes to the inserting station with envelope flaps in an open position;

a pair of rotatable insertion horns positioned at the sides of an envelope inserting station and such insertion horns rotate into the envelope to open the envelope's sides to form a clear channel for the collation to enter, and wherein the insertion horns have an initial position prior to rotation that is fully outside the envelope, prior to arrival of the collation, and that are configured to simultaneously rotate from the initial position into the envelope as the collation is pushed between the insertion horns such that the insertion horns are fully rotated about 90 degrees relative to the initial position into the envelope as the collation begins to enter the envelope, thereby facilitating insertion of the collation without catching on an upstream edge of the insertion horns.

7. The mechanism of claim 6 wherein the insertion horns are configured to rotate fully into the envelope such that side walls of the insertion horns are parallel with the sides of the envelope.

8. The mechanism of claim 7 wherein the insertion horns are configured to relax from their full insertion position by rotating away from the sides of the envelope to remove frictional contact between the sides of the envelope and the insertion horns; and further comprising a take away transport positioned to feed a stuffed envelope from the envelope inserting station.

9. The mechanism of claim 8 wherein the insertion horns are configured to move back to the initial position prior to the envelope feeder feeding of a subsequent empty envelope onto the envelope inserting station.

10. The mechanism of claim 6 wherein the insertion horns are configured to rotate into the envelope only when a lead edge of the collation is in a region between the insertion horns.

11. A method for automated insertion of a collation into an envelope wherein a pair of insertion horns is positioned at the sides of an envelope inserting station and such insertion horns rotate into the envelope to open the envelope's sides to form a clear channel for the collation to enter, the method comprising, feeding the envelope into the envelope inserting station with its flap open;

pushing the collation into the open end of the envelope;

positioning the insertion horns in an initial position that is fully outside the envelope, prior to arrival of the collation;

controlling the insertion horns to simultaneously rotate from the initial position into the envelope as the collation is pushed between the insertion horns to thereby facilitate insertion of the collation without catching on an upstream edge of the insertion horns; and relaxing the insertion horns without returning the insertion horns to the initial position, after insertion of the collation, to reduce frictional contact between the envelope's sides and the insertion horns, and thereby facilitating feeding of the envelope from the envelope inserting station.

* * * * *